US009663275B2

(12) United States Patent
Chisholm

(10) Patent No.: US 9,663,275 B2
(45) Date of Patent: May 30, 2017

(54) VENTED OVERCAP AND LID

(71) Applicant: Owens-Brockway Glass Container Inc., Perrysburg, OH (US)

(72) Inventor: Brian J Chisholm, Sylvania, OH (US)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 818 days.

(21) Appl. No.: 13/937,835

(22) Filed: Jul. 9, 2013

(65) Prior Publication Data

US 2015/0013270 A1 Jan. 15, 2015

(51) Int. Cl.
*B65D 51/16* (2006.01)
*B65D 51/18* (2006.01)

(52) U.S. Cl.
CPC ..... *B65D 51/1672* (2013.01); *B65D 51/1683* (2013.01); *B65D 51/18* (2013.01); *B65D 2251/0018* (2013.01); *B65D 2251/0081* (2013.01); *B65D 2543/00092* (2013.01); *B65D 2543/00435* (2013.01); *B65D 2543/00564* (2013.01)

(58) Field of Classification Search
CPC .... B65D 2251/0018; B65D 2251/0081; B65D 51/145; B65D 51/1611; B65D 51/1633; B65D 51/1638; B65D 51/1672; B65D 51/1688; B65D 51/1683; B65D 51/18; B65D 2543/00092; B65D 2543/00435; B65D 2543/00564
USPC ..... 220/256.1, 231, 361, 362, 367.1; 215/262
See application file for complete search history.

(56) References Cited

U.S. PATENT DOCUMENTS

| | | | | |
|---|---|---|---|---|
| 1,031,053 | A * | 7/1912 | Danz | 220/256.1 |
| 1,170,546 | A * | 2/1916 | Keiner et al. | 220/256.1 |
| 1,555,529 | A | 9/1925 | Taylor | |
| 2,244,316 | A | 6/1941 | Robertson | |
| 2,777,125 | A * | 1/1957 | Weisse | B65D 41/28 220/231 |
| 4,418,834 | A | 12/1983 | Helms et al. | |

(Continued)

FOREIGN PATENT DOCUMENTS

| | | |
|---|---|---|
| DE | 384168 | 10/1923 |
| DE | 10111828 | 9/2002 |

(Continued)

OTHER PUBLICATIONS

PCT International Search Report and Written Opinion, Int. Serial No. PCT/US2014/043071, Int. Filing Date: Jun. 19, 2014, Applicant: Owens-Brockway Glass Container Inc., Mail Date: Dec. 4, 2014.

*Primary Examiner* — J. Gregory Pickett
*Assistant Examiner* — Niki M Eloshway

(57) ABSTRACT

A closure that includes an overcap and a lid carried by the overcap. The overcap has an annular skirt extending along a longitudinal axis for coupling the closure to a container, and an overcap web extending continuously radially inwardly from the annular skirt. The lid is carried radially within the annular skirt. The lid has an annular rim radially proximate to the annular skirt of the overcap, for the sealing the closure to the container. A lid web extends radially inwardly from the annular rim, and has at least one vent therethrough, and is coupled to the overcap around the vent.

16 Claims, 4 Drawing Sheets

(56) References Cited

U.S. PATENT DOCUMENTS

| | | | | |
|---|---|---|---|---|
| 5,160,054 | A * | 11/1992 | Nolte | B65D 51/1688 220/203.05 |
| 5,833,090 | A | 11/1998 | Rojek | |
| 5,899,349 | A * | 5/1999 | Moore | B01L 3/50825 215/277 |
| 5,954,214 | A | 9/1999 | Guezennec et al. | |
| 7,074,443 | B2 | 7/2006 | Thomas et al. | |
| 7,909,204 | B2 | 3/2011 | Antal, Sr. | |
| 2002/0148833 | A1* | 10/2002 | Simon | B65D 21/0222 220/256.1 |
| 2006/0261067 | A1* | 11/2006 | Letica | B44D 3/127 220/254.7 |
| 2009/0114650 | A1* | 5/2009 | Houston, Jr. | B65D 51/28 220/256.1 |
| 2009/0289073 | A1* | 11/2009 | Moore | B65D 77/225 220/745 |
| 2011/0315703 | A1 | 12/2011 | Urushidani et al. | |
| 2013/0334225 | A1* | 12/2013 | Ekkert | B65D 51/1633 220/256.1 |
| 2014/0076894 | A1* | 3/2014 | Chen | B65D 81/2015 220/203.19 |

FOREIGN PATENT DOCUMENTS

| | | |
|---|---|---|
| FR | 539775 | 6/1922 |
| FR | 2737195 | 1/1997 |
| WO | 2007091060 | 8/2007 |

* cited by examiner

VENTED OVERCAP AND LID

BACKGROUND AND SUMMARY OF THE DISCLOSURE

Containers often include a body and a neck finish extending axially from the body to accept a closure. The body usually includes a base, a sidewall extending axially away from the base, and a shoulder between the sidewall and the neck finish. The neck finish typically includes circumferentially extending threads to cooperate with corresponding features of the closure, and a circular end surface to cooperate with a seal on an undersurface of the closure. U.S. Pat. No. 2,244,316 illustrates a glass container and closure of this type.

A general object of the present disclosure is to provide a closure and container package that has a feature to release vacuum in the package, wherein part of the closure can be resealed to the container after use of the vacuum release feature, and wherein the package is readily suited for elevated temperature applications such as hot-fill and retort applications.

The present disclosure embodies a number of aspects that can be implemented separately from or in combination with each other.

A closure in accordance with one aspect of the present disclosure includes an overcap having an annular skirt extending along a longitudinal axis for coupling the closure to a container, and an overcap web extending continuously radially inwardly from the annular skirt. The closure also includes a lid carried by the overcap radially within the annular skirt. The lid has an annular rim radially proximate to the annular skirt of the overcap, for sealing the closure to the container. The lid also has a lid web extending radially inwardly from the annular rim, and having at least, one vent therethrough, and being coupled to the overcap around the vent. A package may include a container having a neck finish with an annular axially facing sealing surface and a radially outward closure engagement surface, and the aforementioned closure coupled to the container such that the annular rim is in sealing engagement with the sealing surface of the container neck finish, and the annular skirt is coupled to the closure engagement surface of the container.

In accordance with another aspect of the present disclosure, a method of manufacturing a package includes assembling a lid of a closure to an overcap of the closure, by applying the lid to a web of the overcap radially within an annular skirt of the overcap, so that the web of the overcap extends over and seals a vent in a web of the lid. The method also includes coupling the closure to a container, by applying an annular rim of the lid to an annular axial sealing surface of a neck finish of the container. A package may be produced by the aforementioned method, and a method of using the package may include peeling the overcap off the container and away from the lid so as to uncover the vent and relieve a vacuum condition in the package to facilitate removal of the lid from the container.

In accordance with a further aspect of the present disclosure, a closure for vacuum packaging applications includes an overcap having a center panel and a peripheral skirt constructed for attachment to a container neck finish, and a lid having a radially outer annular rim and a vent. The closure also includes a seal ring around the vent and removably attaching the lid to an undersurface of the center panel such that the radially outer annular rim of the lid is disposed within the skirt for engagement with the container neck finish.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
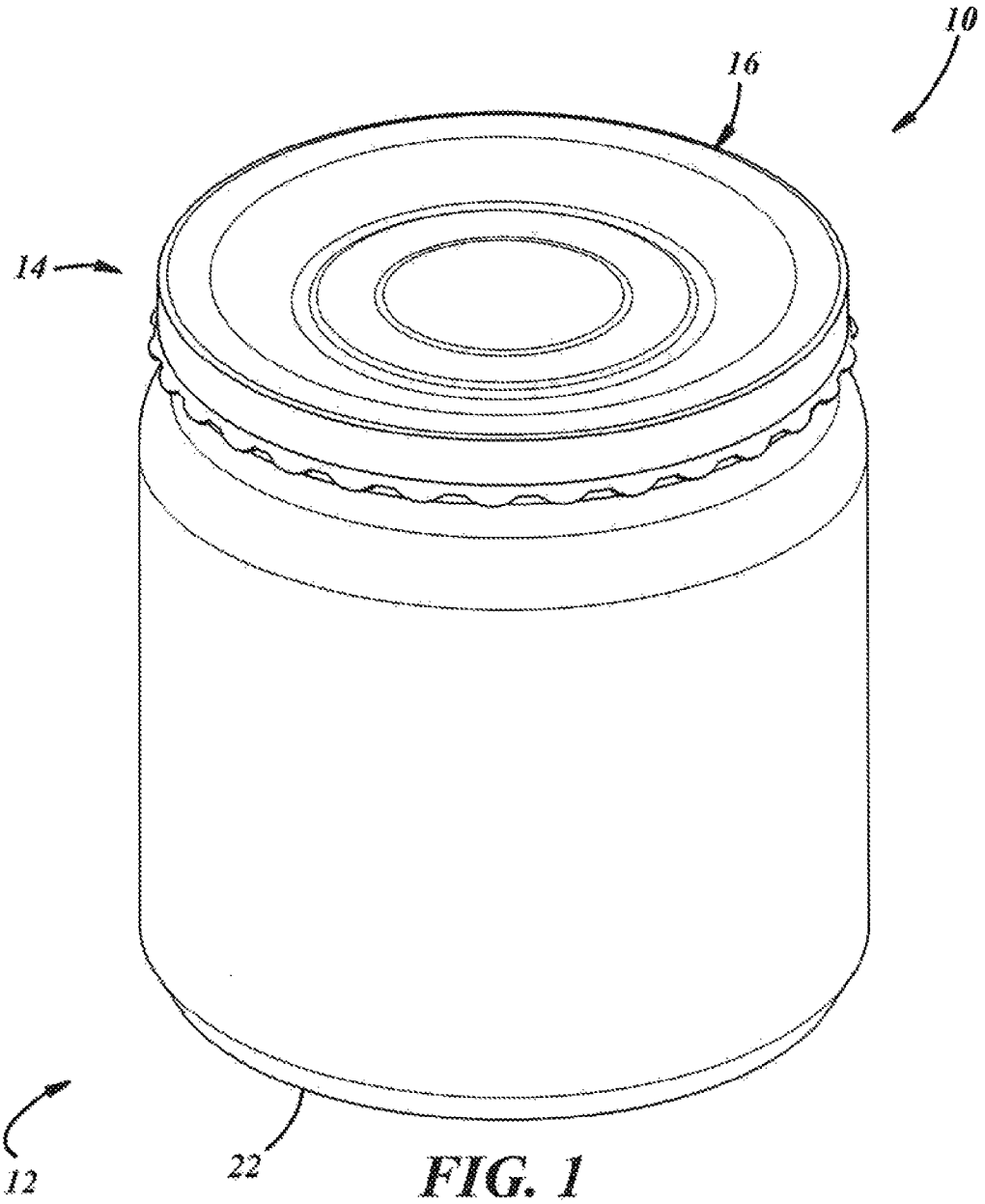
FIG. 1 is a perspective view of a package in accordance with an illustrative embodiment of the present disclosure, and including a container and a closure for the container.

FIG. 1 illustrates a package 10 including a container 12 and a closure 14 coupled to the container 12 for closing and sealing the container 12, and including an overcap 16. The container 12 may be a single, integral, article of manufacture.

Figure 2:
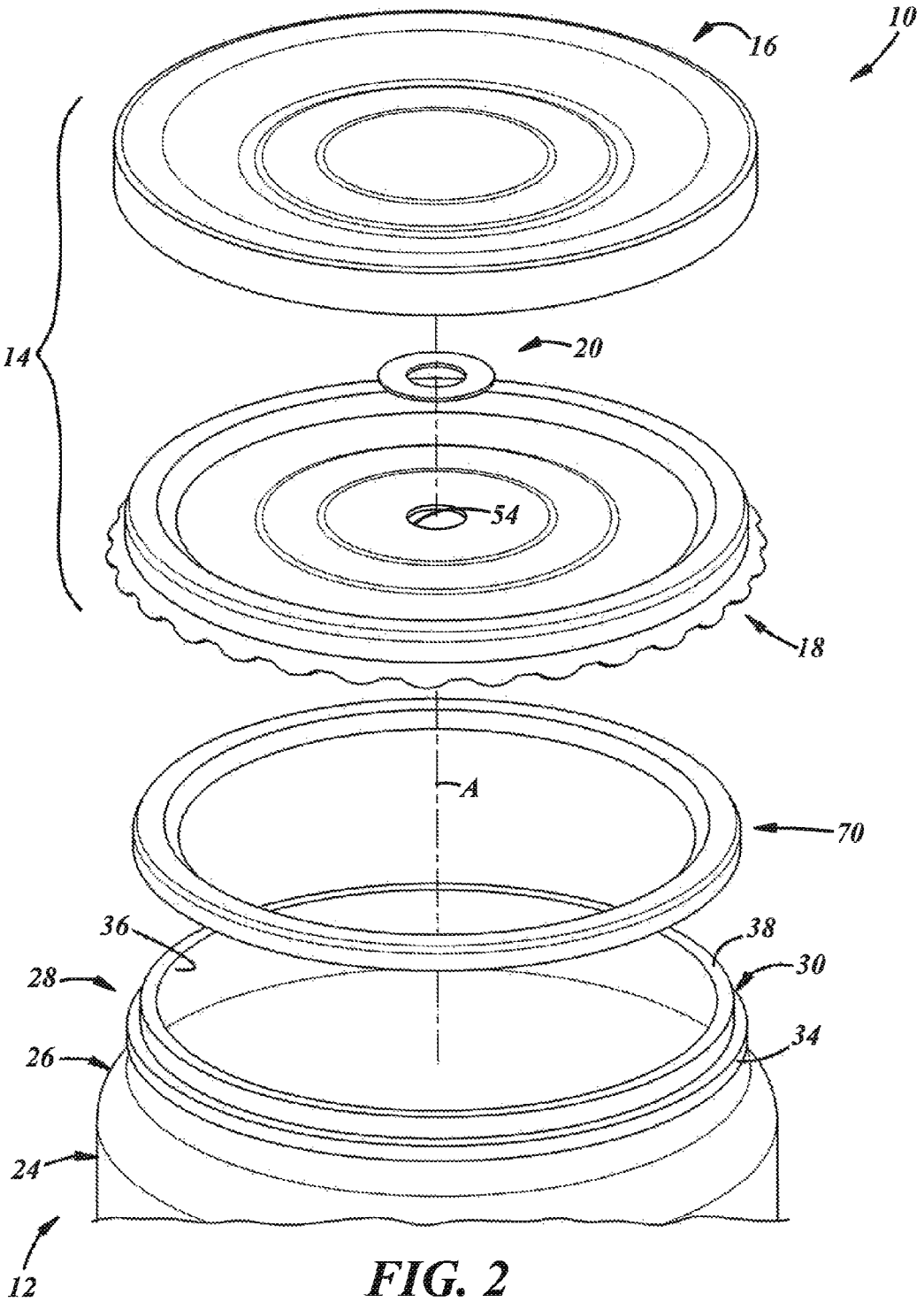
FIG. 2 is an exploded perspective view of the package of FIG. 1, illustrating the closure with a flexible overcap for coupling the closure to the container, a retortable lid for sealing the closure to the container, and a seal between the lid and the container.

With reference to FIG. 2, the closure 14 may be a multiple piece closure, which may include the overcap 16, a separate closure plate or lid 18 disposed between the overcap 16 and the container 12 for closing and sealing the container 12, and a seal, for example, a gasket 70, that may be carried by the lid 18 and disposed between the lid 18 and the container 12. The closure 14 also may include a seal 20 that may be carried by the lid 18 and/or the overcap 16 and may be used to couple and/or seal the overcap 16 to the lid 18. The seal 20 may be a separate component that is assembled between the overcap 16 and the lid 18, or may be a coating or bead of sealant applied to the lid 18 and/or the overcap 16 in situ, or may be of any other suitable configuration. In other embodiments, the overcap 16 may be sealed to the lid 18 directly without the intermediate seal 20, for example, by partial melting of a heat-seal able portion of the overcap 16 to the lid 18, via adhesive between the overcap 16 and the lid 18, or in any other suitable manner. The overcap 16 may carry the lid 18 within its radially outer confines and may be coupled directly to the container 12. In another embodiment, the gasket 70 may be disposed between the lid 18 and the container 12. As will be described in further detail herein below, the package 10 may be a vacuum package, and the overcap 16 may be pried off and peeled away from the container 12 and the lid 18 to disrupt the air-tight seal between the overcap 16 and the lid 18 to thereby release vacuum from within the package 10. For example, such peeling of the overcap 16 from the lid 18 may tear the seal 20 from sealing engagement between the overcap 16 and the lid 18.

The package 10 may be used to package pickles, baby food, salsa, peppers, spaghetti sauces, jams, or any other hot-fill food product(s). The package 10 also may be used to package other types of products including, but not limited to, liquids, gels, powders, particles, and the like. The package 10 may be suitable for hot-fill applications of product at 185° F. and above, and can be used for retort applications at temperatures of 260° F. and above. The package 10 includes a longitudinal axis A, across which the overcap 16 may be peeled with respect to the container 12 and the lid 18. Although the package 10 is illustrated with generally cylindrical components, those of ordinary skill in the art will appreciate that the package 10 can be ovular, or of any other non-cylindrical configuration.

With continued reference to FIG. 2, the container 12 may be composed of glass, or any other material suitable for containing food products, and may be a bottle, jar, bowl, or any other suitable type of container 12. The container 12 includes a base 22 (FIG. 1), a body 24 extending from the base 22, and also may include a shoulder 26 extending from the body 24. In other embodiments, however, the container 12 need not include the shoulder 26. In any event, the container 12 also may include a neck 28 extending from the shoulder 26 (or directly from the body 24). The neck 28 need not be narrower in dimension than the body 24, for example, in the case where the container 12 is a bowl instead of a jar.

The neck 28 includes a neck finish 30 that may include a radially outward closure engagement surface, which may include one or more external, or radially outwardly extending, closure engagement elements 34. The closure engagement element(s) 34 may include a circumferentially continuous radially outwardly extending bead for circumferentially continuous sealed coupling to the closure overcap 16. The engagement element(s) 34 instead may include other radially outwardly extending lugs, bayonets, thread segments, or may include radially inwardly extending grooves, channels, notches, or any other suitable features. In another embodiment, the closure engagement surface need not include any projecting features and, instead, may be lugless, for instance, suitable for a simple factional fit with the overcap 16. The neck finish 30 also includes an open mouth 36 surrounded by an axial sealing surface 38 of the neck finish 30, The sealing surface 38 may face axially for engagement with a corresponding portion of the closure lid 18.

Figure 3:
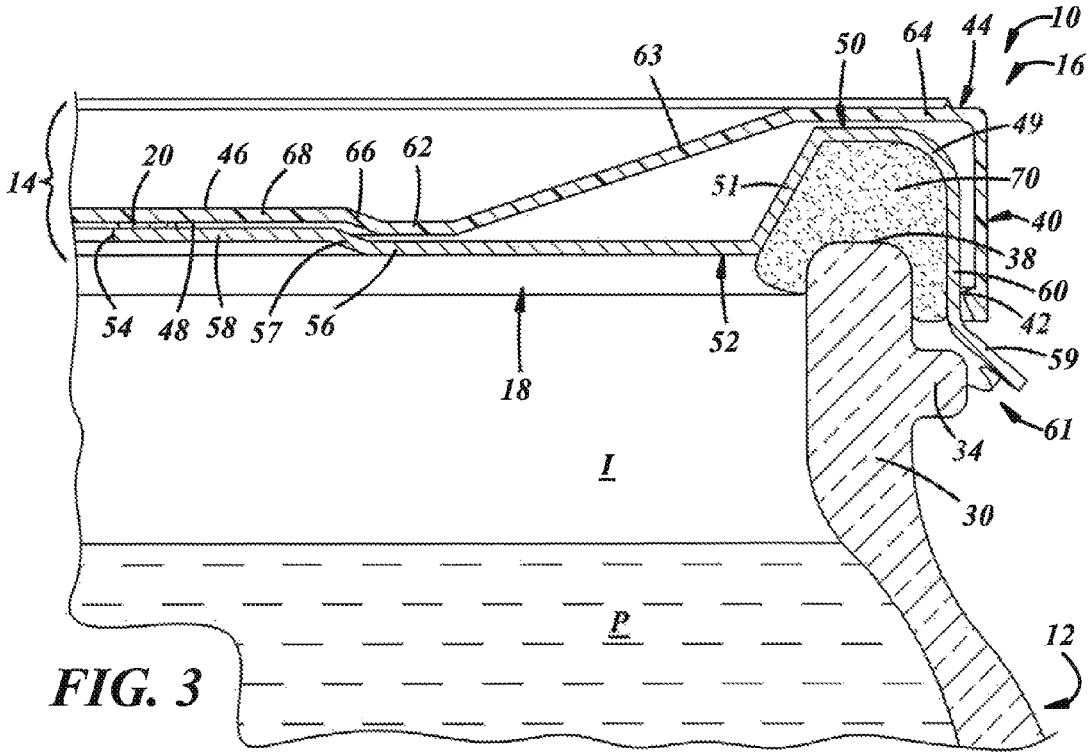
FIG. 3 is an enlarged, fragmentary, sectional view of the package of FIG. 1, illustrating the package in an assembled and sealed condition.

With reference to FIG. 3, the closure 14 may he provided in any suitable sizes, and may be a wide-mouth type of closure when the container 12 is a wide-mouth type of container. The components of the closure 14 may be composed of metal, plastic, glass, ceramic, and/or any other material(s) suitable for use with food products. In particular, the lid 18 may be composed of a retortable or relatively rigid material, whereas the overcap 16 may be composed of a relatively resiliency flexible material. For example, the lid 18 may be composed of metallic or ceramic material, or any other suitable rigid material, whereas the overcap 16 may be composed of a polymeric material, or any other suitable flexible impermeable material. In a more specific example, the lid 18 may be composed of metal, for example, tin-plate, or any other suitable metal, and the overcap 16 may be composed of plastic, for instance, polyethylene, or any other suitable plastic. The container 12, with the closure 14 sealingly coupled thereto, establishes a package interior 1 and may hold a product P within the package 10, for instance, under vacuum.

The overcap 16 has an axially extending peripheral or annular skirt 40 that may have one or more internal, or radially inwardly extending, internal container engagement elements 42 for eventual engagement with the external engagement element(s) 34 on the finish 30. As used herein, the term axial includes oriented generally along a longitudinal axis of the closure, container, or package and may include but is not limited to a direction that is strictly parallel to the axis. The overcap 16 also has a center panel or radially inwardly extending web 44 that extends continuously radially inwardly from the skirt 40. The web 44 of the overcap 16 preferably has no through holes and has an axially external surface 46 and an undersurface or axially internal surface 48.

The lid 18 is carried by the overcap 16 radially within the annular skirt 40. The lid 18 has a radial periphery or radially outer annular rim 50 that is captured between the overcap 16 and the container 12 and, more particularly, between a radially outer annular rim 64 of the overcap web 44 and the container neck finish sealing surface 38. More specifically, the radially outer annular rim 50 may be an annular rim radially proximate to the annular skirt 40 of the overcap 16, for sealing the closure 14 to the container 12. The lid 18 also has a lid web 52 extending radially inwardly from the radially outer annular rim 50 to a center that is radially distal with respect to the annular skirt 40, and having at least one vent 54 therethrough, and being removably attached or coupled to the overcap 16 around and/or over the vent 54 so as to seal the vent 54. The vent 54 may be a center opening centrally located along the axis A, multiple of the vent 54 in a circular array around the axis A, multiple pinholes in any suitable location, one or more slots or slits, or any other suitable vent arrangement.

The lid 18 may include a base wall 56 extending radially outwardly to the annular rim 50, which may include radially outer and inner annular steps 49, 51. The inner step 51 may be a straight angled annulus, and the outer step 49 may be a rounded annulus. The lid 18 also may include stepped panels extending radially inwardly from the base wall 56 and offset in an axially outward direction. For example, an angled annular step 57 extends radially inwardly and axially outwardly from the base wall 56 to a central stepped panel 58 that extends radially inwardly. The lid 18 may or may not include tamper indicating panels that "pop" under a release of vacuum when the lid is removed from a container.

Also, the lid 18 may include a radially outer wall 60, which may be generally cylindrical and may extend generally axially from the rim 50. The wall 60 may be flared radially outwardly at a flared portion 59, which may terminate in a decorative edge 61. The edge 61 may be scalloped with rounded scallops, as illustrated, or may be provided with any other suitable decoration. In any case, the flared portion 59 may extend axially beyond the skirt 40 of the overcap 16 to provide a contrasting or decorative feature of the closure 14. Also, the flared portion 59 may extend radially outwardly beyond a radially outer surface of the overcap 16, for example, as illustrated or in any other suitable manner. In the illustrated example, the flared portion 59 may be disposed between the closure engagement feature 34 of the container 12 and the skirt 40 of the overcap 16.

The overcap 16 generally may conform to the lid 18. For example, the overcap 16 may include a base wall 62 corresponding to the lid base wall 56 and from which a radially outer annular rim 64 of the overcap 16 extends radially outwardly and may be coupled to the base wall 62 by an angled annular step 63. Also, the overcap 16 may include stepped panels 66, 68 extending radially inwardly from the base wall 62 and offset in an axially outward direction.

The lid 18 also may carry the gasket 70, on an undersurface of the annular rim 50. More specifically, the gasket 70 may be carried by the rim 50 between the outer and inner portions 49, 51. The gasket 70 may be composed of PLASTISOL or any other suitable closure gasket material. The gasket 70 may be a separate component that is assembled to the lid 18, a bead of material that may be applied in situ to the lid 18, or of any other suitable configuration. In one embodiment, the gasket 70 may be spun into, or otherwise applied to, the lid 18, and then cured, for example, at a lid manufacturing facility prior to being shipped for use at a packaging facility. The gasket 70 may be fully cured when the lid 18 is applied to the container 12, but may be soft enough to comply with the container 12 when the lid 18 is pressed onto the container 12. The shape of the gasket 70 may determine how well it grips to, and stays on the container 12. In any case, the lid 18 may be pushed onto the container 12 to provide good sealing with the container neck finish 30, for example, with the sealing surface 38 thereof.

With reference to FIG. 3, the seal 20 may be positioned between the overcap 16 and the lid 18 so as to seal the vent 54. In the illustrated embodiment, the seal 20 is an annular seal ring carried by the lid 18 around the vent 54, but in other embodiments, the seal 20 could be a disc covering the vent 54, or could be of any other suitable size, shape, and configuration. The seal 20 may be a heat-sealable seal that removably attaches a portion of the undersurface 48 of the overcap 16 to a corresponding portion of the lid 18 when heat is applied thereto.

According to another embodiment, a method of manufacturing the package 10 may include the following steps. The container 12 may be filled with any suitable product(s). Also, the lid 18 of the closure 14 may be assembled to the overcap 16 of the closure 14, by applying the lid 18 to the web 44 of the overcap 16 radially within the overcap skirt 40 which extends axially from the radially outer annular rim 64 of the web 44, so that the web 44 of the overcap 16 extends over the vent 54 in the web 52 of the lid 18. The assembling step may include heat-sealing the overcap 16 to the lid 18, for example, using the seal 20. Heat sealing may be applied via thermoforming, sonic welding, or in any other suitable manner. More specifically, the seal 20 may be positioned between the lid 18 and the overcap 16 at the vent 54, before coupling the overcap 16 to the lid 18. Moreover, the closure 14 may be coupled to the container 12, by applying the annular rim 50 of the lid 18 to the annular axial sealing surface 38 of the neck finish 30 of the container 12 so that the gasket 70 is interposed between the lid 18 and the container 12, and by applying the annular skirt 40 of the overcap 16 to the closure engagement element 34, The package 10 may be a vacuum type of package wherein a vacuum or negative pressure condition exists in the interior 1 of the package 10, either as the closure 14 is applied to the container 12 or thereafter because of product cooling, retort processing, or any other suitable condition that creates vacuum in the package 10. Accordingly, the closure 14 may be vacuum sealed to the container 12.

In a further embodiment, a method of using the package 10 includes peeling the overcap 16 off the lid 18 and away from, the lid 18 so as to uncover the vent 54 and relieve the vacuum condition in the package 10 to facilitate removal of the lid 18 from the container 12. The method of use also may include separating the lid 18 from the overcap 16, and covering the container 12 by applying the overcap 16 to the container 12 without the lid 18. In some embodiments, the overcap 16 simply may provide a covering for the container 12, and in other embodiments, the overcap 16 may sealingly close the container 12 and may include any suitable additional features to do so, for instance, a plug seal, a skirt seal, and/or an axial seal.

Figure 4:
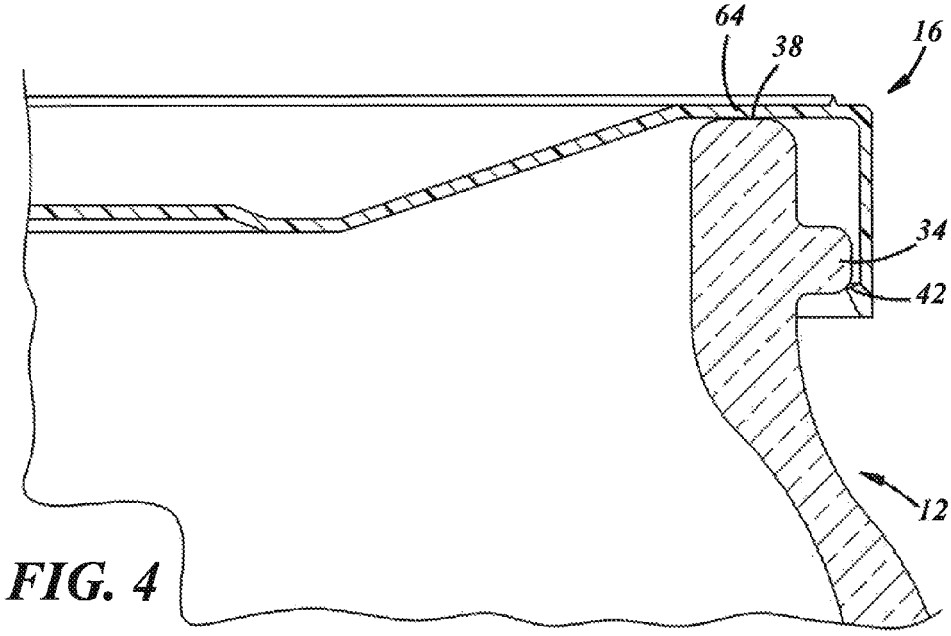
FIG. 4 is an enlarged, fragmentary, sectional view of a package, with the lid removed and the overcap applied directly to the container.

As shown in FIG. 4, the closure overcap 16 may be engaged to the container 12 once the lid 18 is removed. The internal container engagement elements 42 may engage with the external engagement element(s) 34 on the finish 30, and/or a frictional fit therebetween may be used, to secure the overcap 16 to the container 12, Accordingly, the overcap 16 may be sealed to the container 12, for example by axial sealing between the annular rim 64 of the overcap 16 and the axial sealing surface 38 of the neck finish 30 of the container 12.

Figure 5:
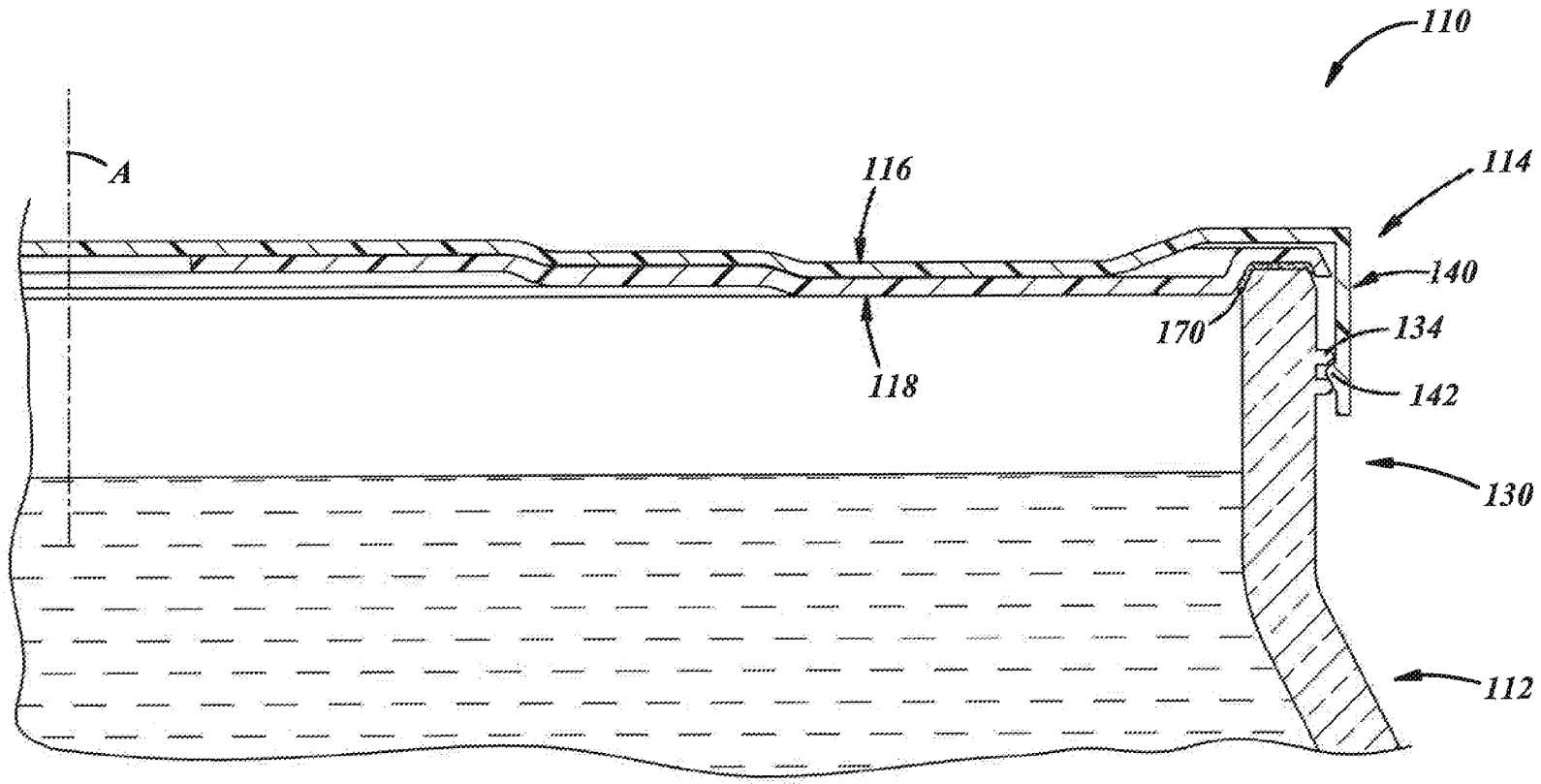
FIG. 5 is a fragmentary sectional view of a package in accordance with another illustrative embodiment of the present disclosure, and including a container, and a closure for the container including an overcap coupled to a neck finish of the container.

FIG. 5 shows another illustrative embodiment, of a package 110. This embodiment is similar in many respects to the embodiment of FIGS. 1-4 and like numerals between the embodiments generally designate like or corresponding elements throughout the several views of the drawing figures. Accordingly, the descriptions of the embodiments are hereby incorporated into one another, and description of subject matter common to the embodiments generally may not be repeated.

The package 110 includes a container 112 and a closure 114 coupled to the container 112 and including an overcap 116 coupled to the container 112 and a separate lid 118 disposed between the overcap 116 and the container 112 for closing and sealing the container 112, and a gasket 170 that may be carried between the lid 118 and the container 112. The overcap 116 includes an axially extending annular skirt 140 having one or more internal container engagement elements 142. The element(s) 142 are directly coupled to external engagement element(s) 134 on a neck finish 130 of the container 112 when the closure 114, including the lid 118, is coupled to the container 112. The elements 134, 142 may include threads and/or thread segments, annular beads and/or head segments, bayonet features, or any other suitable engagement elements.

There thus has been disclosed a package that fully satisfies one or more of the objects and aims previously set forth. The disclosure has been presented in conjunction with an exemplary embodiment, and modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A closure that includes:

an overcap having:

an annular skirt extending along a longitudinal axis for coupling the closure to a container, and an overcap web extending continuously radially inwardly from the annular skirt; and a lid carried by the overcap radially within the annular skirt, composed of a metallic material, and having:

an annular rim radially proximate to the annular skirt of the overcap, for sealing the closure to the container, and a lid web extending radially inwardly from the annular rim, and having at least one vent therethrough, and being coupled to the overcap around or over the vent so as to seal the vent.

2. The closure set forth in claim 1 that includes a seal positioned between the overcap and the lid so as to seal the vent.

3. The closure set forth in claim 2 wherein the seal is a seal ring carried by the lid around the vent.

4. The closure set forth in claim 2 wherein the seal is a heat-sealable seal.

5. The closure set forth in claim 1 that also includes a gasket carried by the annular rim of the lid.

6. A package including:

a container having a neck finish with an annular axially facing sealing surface and a radially outward closure engagement surface; and the closure set forth in claim 1 coupled to the container such that the annular rim is in sealing engagement with the sealing surface of the container neck finish.

7. The package set forth in claim 6 that includes a gasket disposed between the annular rim of the lid and the sealing surface of the container neck finish.

8. A closure that includes:

an overcap having:

an annular skirt extending along a longitudinal axis for coupling the closure to a container, and an overcap web extending continuously radially inwardly from the annular skirt; and a lid carried by the overcap radially within the annular skirt, and having:

an annular rim radially proximate to the annular skirt of the overcap, for sealing the closure to the container, a lid web extending radially inwardly from the annular rim, and having at least one vent therethrough, and being coupled to the overcap around the vent, and a radially outer wall extending axially from the annular rim and having a flared portion flared radially outwardly and extending axially beyond the annular skirt of the overcap.

9. The closure set forth in claim 8 wherein the flared portion terminates in a decorative edge.

10. The closure set forth in claim 9 wherein the decorative edge is scalloped.

11. The closure set forth in claim 8 wherein the flared portion extends radially outwardly beyond a radially outer surface of the overcap.

12. A package including:

a container having a neck finish with an annular axially facing sealing surface and a radially outward closure engagement surface; and the closure set forth in claim 1 coupled to the container such that the annular rim is in sealing engagement with the sealing surface of the container neck finish, and the annular skirt is coupled to the closure engagement surface of the container, wherein the closure engagement surface of the container neck finish includes an external closure engagement element, and the annular skirt of the closure overcap includes an internal container engagement element extending radially inwardly in engagement with the external closure engagement element of the container neck finish.

13. The package set forth in claim 12 that includes a gasket disposed between the annular rim of the lid and the sealing surface of the container neck finish.

14. A closure for vacuum packaging applications, which includes:

an overcap composed of a polymeric material and having a center panel and a peripheral skirt constructed for attachment to a container neck finish, a lid composed of a metallic material and having a radially outer annular rim and a vent and being coupled to the overcap so as to seal the vent, and a seal ring around the vent and removably attaching the lid to an undersurface of the center panel such that the radially outer annular rim of the lid is disposed within the skirt for engagement with a container neck finish.

15. The closure set forth in claim 14 wherein the overcap is of plastic construction and the lid is of metal construction.

16. The closure set forth in claim 14 that includes a gasket carried by the annular rim of the lid for sealing with the container neck finish.

* * * * *